United States Patent [19]

Brooks

[11] 4,134,591

[45] Jan. 16, 1979

[54] CITIZEN BAND RADIO BOARD GAME

[76] Inventor: Michael J. Brooks, P.O. Box 234, Exton, Pa. 19341

[21] Appl. No.: 776,990

[22] Filed: Mar. 14, 1977

[51] Int. Cl.[2] ..... A63F 3/04

[52] U.S. Cl. ..... 273/252; 273/288

[58] Field of Search ..... 273/134 AC, 134 BD, 273/134 ER, 134 GM, 134 E, 134 C, 134 AT, 134 AA, 134 AD, 252, 251, 254

[56] References Cited

U.S. PATENT DOCUMENTS

| | | | |
|---|---|---|---|
| 1,451,511 | 4/1923 | Jones | 273/134 AC |
| 1,652,851 | 12/1927 | Bendtin | 273/134 AC |
| 2,145,394 | 1/1939 | Hobbs et al. | 273/134 AD |
| 3,223,420 | 12/1965 | Turner | 273/134 AA |
| 4,027,882 | 6/1977 | Rosenberg | 273/134 GM |

*Primary Examiner*—Richard T. Stouffer
*Assistant Examiner*—Harry G. Strappello
*Attorney, Agent, or Firm*—Edward J. Sites

[57] ABSTRACT

A citizen band radio is provided which can be played by 2 to 5 players. A board is used which has on it a representation of a road map including an illustration of a road system having a plurality of roads. The roads are divided by playing stations, each playing station of which is used to count the places to be moved by the players. The playing stations on the roads are the dividing lines of the road, locations of cities, hazard areas, areas of good reception and the home stations for each of the players. Two decks of cards are provided; namely, a deck of 56 "breaker" cards and 13 "inspection" cards. A simulated citizen band radio is provided for each player having holes which simulate radio channels. The holes in the radio are sized to hold pegs which simulate crystals required to transmit on each of the channels on the simulated radio. A spinner is further provided in the configuration similar to a citizen band radio microphone. The spinner on being activated displays a number corresponding to a citizen band channel number.

7 Claims, 6 Drawing Figures

CITIZEN BAND RADIO BOARD GAME

SUMMARY OF THE INVENTION

The game simulates citizen band radio usage and familiarizes the players with citizen band transmission language.

DESCRIPTION OF THE PREFERRED EMBODIMENT

Figure 1:
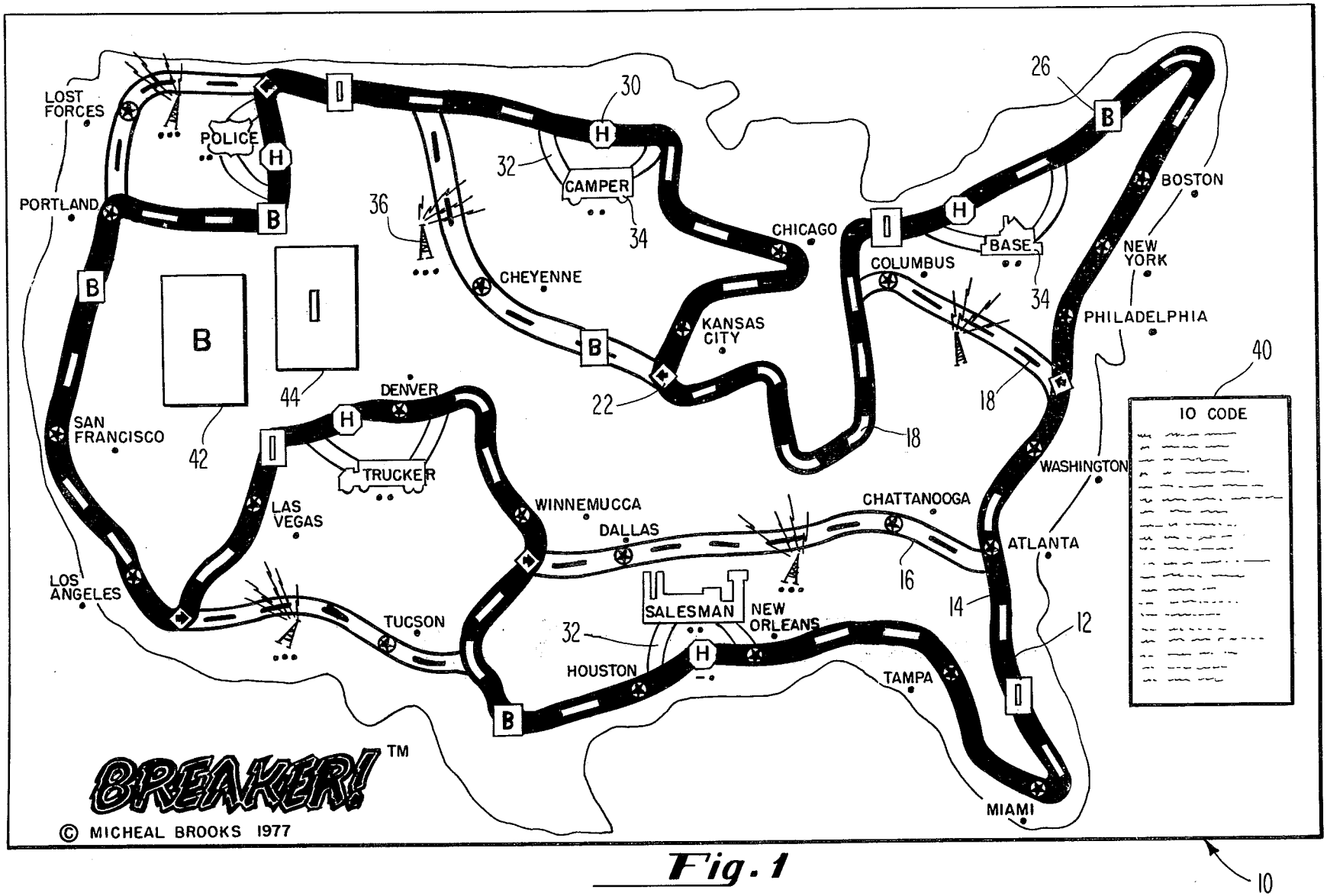
FIG. 1 shows a board containing a representation of a road map having located on the roads thereof cities, areas of good transmission, hazard areas location at which "breaker" or "inspection" cards are drawn and base stations for the players.

In FIG. 1 of the drawing is shown a game board 10. The game board 10 as illustrated is a road map of the United States. It could also be a map of other countries or of an artificial area. The roads 12 are shown as a primary road 14 and secondary roads 16. The primary road 14 as shown is solid and the secondary road 16 is shown in outline form. In a game prepared in a plurality of colors the primary road 14 and secondary roads 16 can be illustrated in different colors to distinguish the roads. On the roads 12 there are illustrated certain indicia. Each indicia is used to indicate a playing station used to count moves by a player. The indicia used on the road includes an elongated dash similar to a center road marker 18, a star in a circle indicating a city 20, optional directional sign 24, squares having the letter "B" within the square 26, squares having the letter "I" within the square 28 and hexagonal hazard sign 20 having a letter "H" within the hexagon. On bypass secondary roads 32 there are located the home stations 34 for each of the players. Adjacent the roads 12 are antenna symbols 36 directed at a particular section of the roads 12 which is used to indicate an area of good citizen band reception. Under the name of the cities 20, antenna symbols 36, the home stations 34 and the hazard symbols 30 are dots which indicate the number of crystals 38 which may be acquired by landing on in the case of the home station 34 passing by the designated indicia for the player.

In addition to the roads 12 and indicia noted above the board further includes a panel 40 which sets out the more common 10 code numbers which are used in citizen band radio to familiarize the players with the code. The code set out in the panel 40 reads as follows:

10 CODE 10-1 — Receiving Poorly
10-2 — Receiving Well
10-3 — Stop Transmitting
10-4 — O.K. Message Received
10-7 — Out of Service
10-13 — Advise Weather or Road Conditions 10-17 — Urgent Business
10-20 — My Location Is
10-21 — Call by Telephone
10-22 — Report in Person to
10-30 — Does not Conform to F.C.C. Rules
10-35 — Confidential Information
10-36 — Correct Time
10-42 — Traffic Accident at
10-67 — All Units Comply
10-73 — Speed Trap at
10-75 — You're Causing Interference at
10-81 — Reserve Hotel Room
10-99 — Mission Completed
10-200 — Police Needed The board 10 also has provided there a space 42 for the "breaker" cards and a space 44 for the "inspection" cards.

Figure 2:
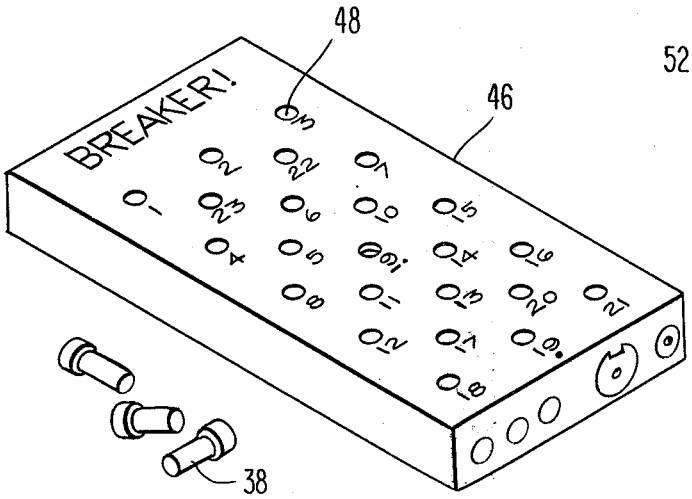
FIG. 2 is an illustration of a simulated radio having holes for plugs and the plugs which are used as simulated crystals to obtain active channels for the radio.

In FIG. 2 there is illustrated a simulated radio 46 and a simulated crystal 38. The radio 46 has holes 48 in it to receive the crystal 38 as acquired in the course of the game as explained below. The number nine channel hole is blocked off for reasons to be explained below. As shown, the radio has 23 channels as is conventional with citizen band radios sold prior to Jan. 1, 1977. The radio 46 could likewise be made with 40 or more channel holes 48 if desired.

Figure 3:
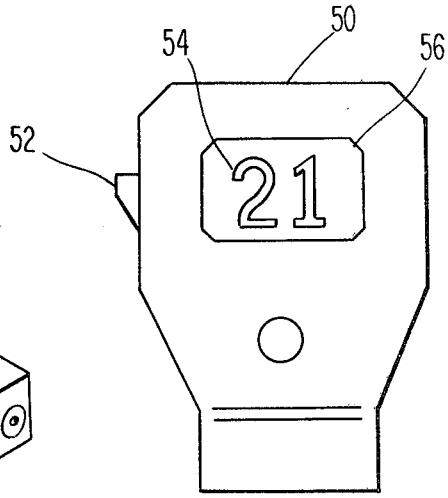
FIG. 3 is an illustration of a simulated citizen band radio microphone which has incorporated in it a spinner for randomly selected numbered channels.

In FIG. 3 a simulated citizen band radio microphone 50 is shown. Built within the radio microphone 50 is a spinner (not shown) which is operated by the microphone switch 52. After the spinner is activated a number 54 will appear in the window 56 of the radio microphone 50.

Figure 4:
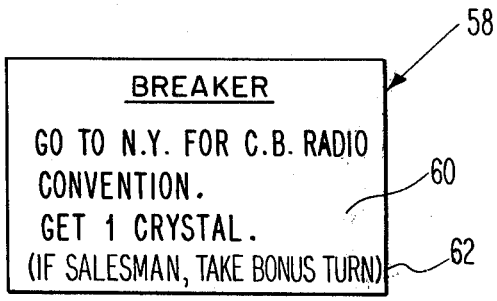
FIG. 4 is an illustration of a typical "breaker" card.

In FIG. 4 a typical "breaker" card 50 is shown. The "breaker" card contains a general message 60 for any player who draws the card and directions 62 for a bonus turn if a particular named player selects the card. The "breaker" cards read as follows:

1. You're 10-2. Your station wagon's needed in Phila. Motor over for one crystal. (if base take bonus turn)
2. Scoot to San Francisco for a 10-17 there. Get one crystal on arrival. (if salesman take bonus turn)
3. Go to lost forces for ham radio field party. Get two crystals. (if camper take bonus turn)
4. You just found a snake in your sleeping bag. Get one crystal in Winnamucca. (if camper take bonus turn)
5. Break for channel 8. If anyone answers three crystals you take. (if salesman take bonus turn)
6. Get on crystal if you pass the next "Chicken Coop" Inspect Station. (if truck take bonus turn)
7. There's a 10-35 in Columbus Ohio so head there right now so that no one goes by you. One crystal on arrival. (if salesman take bonus turn)
8. Set up a 10-73 at Houston. Go there if anyone passes you before your next turn, get a crystal (hold this card 1 turn). (if smokey take bonus turn)
9. A 10-200 needed in Chattanooga. Head there for one crystal. (if smokey take bonus turn)
10. 10-4, Roger! Take one crystal. (if base take bonus turn)
11. Put the pedal to the metal and go to Chicago, get two crystals. (if smokey take bonus turn)
12. Wake up there you old catfish! Go to Cheyenne for one crystal. (if base take bonus turn)
13. Throw the wife and kids in van. Then hit the turnpike to Cheyenne. Upon arrival give a spin for any odd, a crystal win. (if camper take bonus turn)

14. Go 10-67 with all your bear friends. Meet them in Boston for two crystals. (if smokey take bonus turn)
15. Drive to Denver for citizen band marketing convention. Get two crystals there. (if salesman take bonus turn)
16. Go 10-22 to Dallas for a trial. Get one crystal. (if smokey take bonus turn)
17. You made the trip to Washington legally. Go there and get two crystals. (if base take bonus turn)
18. Head to Boston for a New England vacation. Get one crystal there for remembering to give your mother a 10-21. (if camper take bonus turn)
19. Go to Boston and meet an old buddy for one crystal. (if salesman take bonus turn)
20. Make it to New Orleans for one crystal. 73's on ya and have a safe and a sound one. (if camper take bonus turn)
21. You made a 10-81 in Las Vegas. Go there for one crystal. (if camper take bonus turn)
22. Mersey Sakes and a pile of old laundry! Go out to Portland and get one crystal. (if base take bonus turn)
23. My! My! You just sold a dozen stolen citizen band radios. Pick an Inspection Card! (if salesman take bonus turn)
24. Nice to modulate with you Camper man. Make it to Miami for fun in the sun. Get one crystal there, we're down. (if camper take bonus turn)
25. Good Golly Gus! Nitro's the name, getting there's the game. Truck it to Tuscon for two big crystals. 73's and safe "truckin". (if truck take bonus turn)
26. You got a Smokey with a picture taker 5 mi. ahead. Go to Philadelphia for two crystals. (if camper take bonus turn)
27. Bear season opened today. Take an Inspection Card. (if smokey take bonus turn)
28. Go 10-8. If anyone calls you before your next turn, take two crystals and keep the card 1 turn. (if base take bonus turn)
29. Your 10-99. Go home for one crystal. (if smokey take bonus turn)
30. Take a load of Cadillacs to Cheyenne. Get two crystals there. (if truck take bonus turn)
31. O.K. there Tiny Trucker, take one crystal for your fine signal. (if truck take bonus turn)
32. Get two crystals for winning at the Roulette table in Las Vegas. Go there and get them. (if camper take bonus turn)
33. Your antenna just blew down. Pick an Inspection Card. (if base take bonus turn)
34. Your "better half" beckons a 10-16, two crystals if anyones listening on six. (if base take bonus turn)
35. Go to Miami and juice up. Take one crystal there in the Sunshine State. (if truck take bonus turn)
36. Make it to Chattanooga and meet the Farmer's daughter for two biggies. Take two crystals. (if salesman take bonus turn)
37. County Mounty just gave you a ticket. Drive down to Dallas and lose one turn. (if trucker take bonus turn)
38. Your big beam antenna puts out a great signal. Take one crystal. (if base take bonus turn)
39. Illegal moonshine operation in Atlanta. Go there for two crystals. (if smokey take bonus turn)
40. Tow-truck overturned in Tampa. Make the trip and get a crystal. (if base take bonus turn)
41. Kansas City needs a tiajuana taxi. Go there for one crystal. (if smokey take bonus turn)
42. Go to New York for citizen band radio delivery. Get one crystal. (if salesman take bonus turn)
43. Hey Good Buddy! We thank you for the break. Hit the hammer hard and haul them hogs to Houston. One crystal upon delivery. (if truck take bonus turn)
44. Key your microphone and call for a break, if anyone answers, two crystals you'll take. (if salesman take bonus turn)
45. Go to Los Angeles for Police Convention get one crystal. (if smokey take bonus turn)
46. Drop it down to four for a short. If you got a crystal in 4, take one for being on the side. (if truck take bonus turn)
47. Go to lost forces with a load of cars. Get two crystals. (if truck take bonus turn)
48. Go to you home 10-20 to give your mother a citizen band radio for Xmas. Get one crystal. (if camper take bonus turn)
49. Ride that rattle trap truck to Boston for two crystals. (if truck take bonus turn)
50. A big wig in the lumber industry just ordered citizen band radios for all vehicles. Truck it to Tampa and close deal for two crystals. (if salesman take bonus turn)
51. Cut the coax and go 10-7 for one turn. (if camper take bonus turn)
52. You just drove under a low bridge and broke off your new whip. Take an Inspection Care for littering. (if camper take bonus turn)
53. There, there Bear go to lost forces and make an arrest for one crystal. (if smokey take bonus turn)
54. Your girlfriend sends you a pair of eights. Too bad she sent them on channel nine during a five state emergency practice drill. Take an Inspection Card. (if smokey take bonus turn)
55. Put your speedometer on the double nickel and head to New York for two big crystals. (if truck take bonus turn)
56. Mersey me! Make it to Miami and meet the mayor. Get one crystal for your great sales and citizen band equipment this year. (if salesman take bonus turn)

Figure 5:
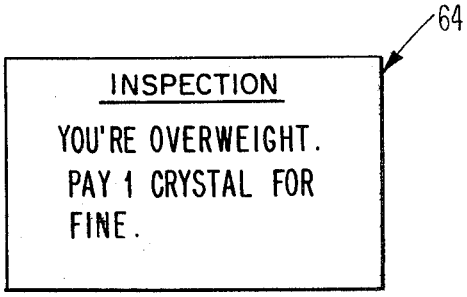
FIG. 5 is an illustration of a typical "inspection" card.

In FIG. 5 a typical "inspection" card 64 is shown. "Inspection" cards 64 generally result in a penalty and or lost crystals. The "inspection" cards read as follows:

1. You're over weight. Pay one crystal for fines.
2. Mercy me. You blew up your radio. Go to Dallas and pay one crystal for a new citizen band radio.
3. Lose two turns for throwing those bad carriers.
4. Go 10-3 right now. Go to Miami and lose one crystal.
5. Your rig is definitely 10-1. Cruise to Columbus for repairs. Lose one turn there because of back ordered parts.
6. Go 10-7 for two turns, a 10-42 is delaying you.
7. You're operating 10-30. Go to San Francisco F.C.C. office. Lose one turn and one crystal.
8. The local gas station attendent just spilled gasoline all over your new bumper mount antenna. Go 10-7 for one turn till it dries out.
9. A 10-13 indicates "bridge out ahead" lose one turn for delays.
10. You refused to give a 10-36 during a react emergency drill. Lose two turns.

11. F.C.C. Citation for use of illegal 250 watt citizen band radio. Go to Boston for hearing and lose one crystal for fines. Go 10-7 for one turn.
12. Your 10-75 due to over-modulation. Lose one crystal.
13. You just keyed your microphone with no antenna. Your rig is now permanently 10-7. Go to lost forces and purchase a new one for one crystal.

Figure 6:
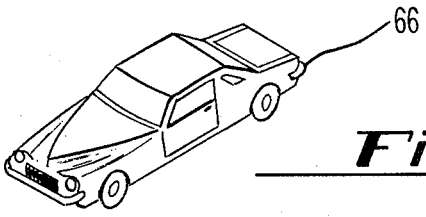
FIG. 6 is an illustration of a typical token used in the game, namely, a salesman car.

In FIG. 6 the token for a salesman is shown, namely, a car 66. The other players have similar tokens which corresponds to their general function. For example, a tractortrailer token is used by the player who is the trucker; a police car token for the player who is the policeman or "smokey" and a van camper token is used by the camper. For a player who is the base station various types of tokens such as a enlarged radio token or a station wagon can be used.

In playing the game each player choses an identifying token such as the salesman car, the tractortrailer, camper van or the like. The "breaker" cards 58 are placed on the board 10 at the designated space 26. The "inspection" cards 64 are likewise placed at their designated space 28. A radio 46 is provided to each player with all of the channel holes 48 empty. A supply of the crystals 38 are placed in a location conventional to all the players and each player is given three crystals 38.

Each player inserts the three crystals 38 which he initially received into any channel hole 48 in his radio 46 except the channel hole for channel nine.

Each player places his token at his particular home station 34. During the play of the game each time a player passes his home station 34 he receives 2 crystals 38 for his radio 46. Preferably each player is given his own radio microphone 50. Each player initially keys the radio microphone 50. The player having the highest channel number 54 starts the play.

The starting player commences the game by keying his radio microphone 50. The player announces to the other players the channel number 54 which appears on his microphone by using citizen band language. For example, if number 13 were to appear the player states "Breaker 13." Any player having a crystal 38 in the named channel hole 48 of his radio responds by replying "Go ahead Breaker." If there is no response to the player's breaker call indicating that none of the other players have a crystal in the designated channel, the player moves a number of playing stations equal to the number 54 displayed on the microphone.

If a player fails to call or answer properly, for example, by failing to use the citizen band language or if an opposing player fails to answer when he has a crystal in the named channel the party making the mistake loses his next turn and one crystal.

If a player keys his radio microphone 50 and announces his channel by stating "Breaker " and the number of the channel if any other player has a crystal in the channel he replies "Go ahead Breaker". The player then having the action selects a "breaker" card and follows the instructions on the "breaker" card rather than moving the number which appears on the radio microphone.

In addition to obtaining "breaker" cards 58 by being answered by another player, "breaker" cards are obtained by moving the number of spaces noted on the microphone and landing on a square marked with the letter "B" 26. The instructions on the "breaker" card are followed immediately.

"Inspection" cards 64 are obtained whenever a player lands on a square having the letter "I" therein 28 or as a result of instructions obtained from a "breaker" card. The instructions on an "inspection" card are followed immediately.

Crystals are obtained in several ways. If the player lands on a city he receives a crystal unless the move was directed to the city by a "breaker" or "inspection" card.

Two crystals are obtained by passing the player's own home station 34 whether the player lands on the home station 34 or passes by the home station.

Three crystals are obtained by a player landing in an area of good reception noted by the antenna symbol 36.

Crystals may be allowed to be obtained as a result of the directions given in a "breaker" card.

One crystal is lost as a result of landing on a hazard area 30. The player whose home station is adjacent avoids the hazard area 30 by taking the bypass road 32 to the player's home station 34.

Crystals may also be lost as a result of instructions obtained from an "inspection" card.

The crystal 38 when received by a player is immediately placed in any empty channel hole 48 (except channel 9). When crystals 38 are lost the player can remove any crystal he desires from his radio.

The play is in a counterclockwise direction. A player must remain on the primary road 14 unless he lands on a directional sign 22. The player then has the option on the next turn to continue on the primary roads 12 or to take the secondary roads 16. The player may also be placed on a secondary road 16 as a result of instructions from a "breaker" or "inspection" card.

Channel nine is an emergency channel and is not used. If a player keys channel nine the player forfeits his turn and also loses one crystal.

Channel nineteen is the trucker channel and is considered a lucky channel if a player keys channel nineteen, he receives an additional turn and also receives a crystal.

If a player lands on a playing station already occupied by another player the last player to arrive can at his option send the other player back to his home station or take an additional turn.

To win the game a player must fill all the channels (except channel nine). The player then announces to the other players that he has completely filled his radio by stating "Breaking for Channel Master". The player then proceeds back to his home station and commences to completely travel around the board on the primary roads without losing any crystals and returns to his home station 34. During the attempt to travel around the board the player can not draw and "breaker" cards. If the player loses a crystal 38 he must regain the lost crystal and again attempt to circle the board. The first player to completely fill the channels and circle the board is the winner.

It will be apparent to those skilled in the art that various changes may be made in the invention, without departing from the spirit and scope thereof and, therefore, the invention is not limited by that which is specially shown in the drawing and described in the upper pending claims.

What is claimed is:

1. A citizen band radio game comprising of:

(a) a board having defined thereon a road system comprised of a series of interconnected roads which form closed loops; said roads having a plurality of playing stations spaced apart from each other with certain of said playing stations having special indicia indicating additional action to be taken, (b) a plurality of tokens each being identifiable with a player of the game, (c) a simulated citizen band radio for each player, said radio having a plurality of apertures defined therein, each aperture having a distinctive number associated therewith, the number of apertures being equivalent to a given number of simulated radio channels, (d) a plurality of peg shaped members of a shape to fit into the apertures of the radio, (e) two decks of cards, the first deck being comprised of a plurality of "breaker" cards and the second deck being comprised of "inspection" cards and (f) a spinner means having a series of numbers corresponding to the given number of simulated channels of the radio, the numbers corresponding to the distinctive numbers of said radio, whereby a game is provided wherein the object is for each player to attempt to collect pegs which are used to simulate radio crystals for the player's radio until all the apertures of the radio are filled with the pegs, said pegs being obtained or lost in accordance with the number determined by the spinner, the indicia on the board and directions given by the "breaker" and "inspection" cards.

2. A game according to claim 1 further including on the board selected indicia defining location of cities, the starting position of players, hazard areas, areas of good reception and positions wherein a "breaker" card or an "inspection" card is drawn.

3. The game according to claim 1 wherein the spinner is in the configuration of a radio microphone and the spinner is activated by the key of the radio microphone.

4. The game according to claim 1 wherein the tokens are of a configuration of a salesman car, a police car, a truck and a camper van with an additional distinctive symbol being used to represent a base station.

5. The game according to claim 1 wherein the simulated radio has twenty-three apertures.

6. The game according to claim 1 wherein the simulated radio has forty apertures.

7. The game according to claim 1 wherein the road system is comprised of a primary road which encircles the board and a plurality of secondary roads which interconnect with the primary road.

* * * * *